US009730290B2

(12) United States Patent
Lee et al.

(10) Patent No.: US 9,730,290 B2
(45) Date of Patent: Aug. 8, 2017

(54) DIMMABLE AC DRIVEN LED ILLUMINATING APPARATUS

(71) Applicant: Seoul Semiconductor Co., Ltd., Ansan-si (KR)

(72) Inventors: Keon Young Lee, Ansan-si (KR); Chung Hoon Lee, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 15/142,568

(22) Filed: Apr. 29, 2016

(65) Prior Publication Data

US 2016/0249429 A1 Aug. 25, 2016

Related U.S. Application Data

(63) Continuation of application No. 14/507,347, filed on Oct. 6, 2014, now Pat. No. 9,345,094.

(30) Foreign Application Priority Data

Oct. 4, 2013 (KR) ..... 10-2013-0118823

(51) Int. Cl.
*H05B 37/02* (2006.01)
*H05B 33/08* (2006.01)

(52) U.S. Cl.
CPC ..... *H05B 33/0851* (2013.01); *H05B 33/083* (2013.01); *H05B 33/0809* (2013.01); *H05B 33/089* (2013.01); *H05B 33/0845* (2013.01); *H05B 33/0848* (2013.01)

(58) Field of Classification Search
CPC .. H05B 37/02; H05B 33/083; H05B 33/0803; H05B 33/0851; H05B 33/0809; H05B 33/089; H05B 33/0845; H05B 33/0848; Y02B 20/48; Y02B 20/341
USPC ... 315/307, 291, 294, 312, 185 R, 186, 194, 315/200 R
See application file for complete search history.

(56) References Cited

U.S. PATENT DOCUMENTS

| | | | |
|---|---|---|---|
| 8,102,167 | B2 | 1/2012 | Irissou et al. |
| 8,115,419 | B2 | 2/2012 | Given et al. |
| 8,203,276 | B2 | 6/2012 | Shackle et al. |
| 8,299,724 | B2 | 10/2012 | Huynh |
| 8,536,798 | B2 | 9/2013 | Matsuda et al. |
| 8,581,517 | B2 | 11/2013 | Kuo et al. |
| 8,624,514 | B2 | 1/2014 | Kang |

(Continued)

FOREIGN PATENT DOCUMENTS

| | | |
|---|---|---|
| EP | 2584866 | 4/2013 |
| JP | 2004-327152 | 11/2004 |

(Continued)

OTHER PUBLICATIONS

Extended European Search Report issued on May 12, 2015, in European Patent Application No. 14186988.3.

(Continued)

*Primary Examiner* — Haissa Philogene
(74) *Attorney, Agent, or Firm* — H.C. Park & Associates, PLC

(57) ABSTRACT

A dimmable alternating current (AC) driven light emitting diode (LED) illuminating apparatus including a TRIAC dimmer configured to perform a dimming control using a phase control.

16 Claims, 6 Drawing Sheets

(56) References Cited

U.S. PATENT DOCUMENTS

| | | | | |
|---|---|---|---|---|
| 8,723,439 | B2 | 5/2014 | Leung et al. | |
| 8,766,550 | B1 | 7/2014 | Yoon et al. | |
| 8,823,266 | B2 * | 9/2014 | Qin | H05B 33/0809 315/120 |
| 8,901,841 | B2 | 12/2014 | Choi et al. | |
| 8,947,016 | B2 | 2/2015 | Melanson et al. | |
| 9,000,680 | B2 * | 4/2015 | Melanson | H05B 33/0809 315/291 |
| 9,078,327 | B2 * | 7/2015 | Livschitz | H05B 33/0848 |
| 9,220,143 | B2 * | 12/2015 | Jung | H05B 33/0815 |
| 2012/0319610 | A1 | 12/2012 | Yoshinaga | |
| 2013/0141008 | A1 | 6/2013 | Chang et al. | |

FOREIGN PATENT DOCUMENTS

| | | |
|---|---|---|
| JP | 2011-077037 | 4/2011 |
| JP | 2011-113711 | 6/2011 |
| JP | 2012-069308 | 4/2012 |
| JP | 2012-165642 | 8/2012 |
| JP | 2013-020931 | 1/2013 |
| JP | 2013-033651 | 2/2013 |
| JP | 2013-037837 | 2/2013 |
| JP | 2013-118164 | 6/2013 |
| WO | 2012168827 | 12/2012 |

OTHER PUBLICATIONS

Non-Final Office Action issued on Aug. 28, 2015, in U.S. Appl. No. 14/507,347.

Notice of Allowance issued on Jan. 15, 2016, in U.S. Appl. No. 14/507,347.

* cited by examiner

DIMMABLE AC DRIVEN LED ILLUMINATING APPARATUS

CROSS-REFERENCE TO RELATED APPLICATION

This application is a continuation of U.S. patent application Ser. No. 14/507,347, filed on Oct. 6, 2014, and claims priority from and the benefit of Korean Patent Application No. 10-2013-0118823, filed on Oct. 4, 2013, which is hereby incorporated by reference for all purposes as if fully set forth herein.

BACKGROUND

Field

The present invention relates to a dimmable alternating current (AC) driven light emitting diode (LED) illuminating apparatus, and more particularly, to an AC driven light emitting diode (LED) illuminating apparatus capable of displaying an appropriate dimming level over an entire section of the dimming level using a TRIAC dimmer configured to perform is dimming control via phase control.

Discussion of the Background

Generally, a diode device for light emission such as a light emitting diode (LED) has been driven only by direct current (DC) power due to diode characteristics. Therefore, a light emitting apparatus using an LED according to the related art has been restrictively used, and should include a separate circuit such as a switching mode power supply (SMPS) in order to be driven by alternating current (AC) power of 220V that is currently used at home. Therefore, a circuit of the light emitting apparatus has become complicated, and a cost required for manufacturing the light emitting apparatus has increased.

In order to solve these problems, research into an LED that may be driven even by AC power by connecting a plurality of light emitting cells in series with or parallel with each other has been actively conducted.

In order to solve the problems in the related art as described above, a sequential driving scheme of LEDs using AC power has been suggested. According to the sequential driving scheme, when an illuminating apparatus including three LED groups is assumed, in a situation in which an input voltage is increased over time, a first LED group first starts to emit light at Vf1, a second LED group connected in series with the first LED group starts to emit light at Vf2 higher than Vf1, and a third LED group connected in series with the second LED group and the first LED group starts to emit light at Vf3 higher than Vf2. In addition, in a situation in which the input voltage is decreased over time, the third LED group stops emitting the light at Vf3, the second LED group stops emitting the light at Vf2, and the first LED group finally stops emitting the light at Vf1, such that an LED driving current is designed so as to be approximate to the input voltage.

Meanwhile, a dimming control of the LED indicates that a luminescent flux or an illumination (Lux) of an LED illuminating apparatus, that is, generally, a brightness of a light source is changed depending on an applied supplying voltage, and a dimmable light source means an apparatus performing the above-mentioned illumination control function in the illuminating apparatus. This LED dimmable system is included in the LED illuminating apparatus in order to decrease power consumption of the LED illuminating apparatus and efficiently operate the LED illuminating apparatus. Particularly, heat generated due to a continuous light emitting operation of the LED is a factor of decreasing quality and efficiency of an illuminating operation. Therefore, in order to reflect a demand by a user and decrease power consumption, a dimming function has been generally added to the LED illuminating apparatus. Among the LED illuminating apparatuses to which the dimming function is added, the LED illuminating apparatus using the DC power as described above is driven by converting the AC power into the DC power using the SMPS. Therefore, dimming is relatively easy, such that dimming control characteristics may be expected to some degree.

However, in the case of the AC driven LED illuminating apparatus as described above, the LED is driven only by a voltage generated by rectifying the AC power, such that it is not easy to implement a dimming function and it is difficult to secure linearity in a dimming control. Particularly, in the case of an AC driven LED illuminating apparatus using the sequential driving scheme, since a driving voltage fluctuates due to a phenomenon that a power supply voltage temporally descends or ascends simultaneously with turning on/off the LEDs at the next step due to internal impedances of an AC power supplying line and a dimmer at a point in time in which the number of LED groups light-emitted depending on a magnitude of the driving voltage is changed (for example, a change point in time from 1-stage driving to 2-stage is driving, a change point in time from 2-stage driving to 3-stage driving, or the like), that is, a change point in time in which the driving voltage divided into two stages or more is exceeded, such that an unstable phenomenon may occur. That is, in the case of the AC driven LED illuminating apparatus having the dimming function according to the related art, ideal illumination change characteristics do not appear over an entire section of a dimming level, and a phenomenon that a luminescent flux is irregularly changed in a portion of a dimming control section occurs.

BRIEF SUMMARY OF THE INVENTION

The present invention is to solve the problems in the related art as described above.

An object of the present invention is to provide an alternating current (AC) driven light emitting diode (LED) illuminating apparatus capable of having improved dimming characteristics over an entire section of a dimming level.

Another object of the present invention is to provide an AC driven LED illuminating apparatus capable of displaying very excellent dimming characteristics by interworking with a TRIAC dimmer configured to perform a dimming control using a phase control.

Still another object of the present invention is to provide an AC driven LED illuminating apparatus capable of overcoming a fluctuation phenomenon that LED groups are repeatedly turned on and turned off at the time of being sequentially driven.

Yet still another object of the present invention is to provide an AC driven LED is illuminating apparatus capable of more efficiently performing a dimming control by changing an LED driving current associated with a driving voltage phase-controlled depending on a dimming level.

Yet still another object of the present invention is to provide an AC driven LED illuminating apparatus capable of removing a phenomenon that a brightness irregularly fluctuates even though a first dimming level of a dimmer is excessively low due to a limitation function of maintaining an LED driving current for 1-stage driving as a predetermined value even at a minimum dimming level.

Characteristic configurations of the present invention for accomplishing the objects of the present invention as described above and unique effects of the present invention to be described will be described below.

According to an exemplary embodiment of the present invention, there is provided a dimmable AC driven LED illuminating apparatus including: a dimmer receiving AC power and controlling the received AC power depending on a selected dimming level to generate and output the controlled AC power; a rectifying unit receiving the controlled AC power output from the dimmer and full-wave rectifying the controlled AC power to generate and output a driving voltage; a dimming level detecting unit receiving the driving voltage to detect the selected dimming level and outputting the detected dimming level signal; first to n-th LED groups (n indicates a positive integer equal to or larger than 2) receiving the driving voltage to be sequentially driven depending on a control of an LED driving module and including one or more LEDs, respectively; and the LED driving module judging a voltage level of the driving voltage, controlling the sequential driving of the first to n-th LED groups depending on the judged voltage level of the driving voltage, and performing a constant current control on an LED driving is current based on the dimming level signal.

The LED driving module may determine a reference value of the LED driving current in proportion to a magnitude of the dimming level signal and control a maximum value of the LED driving current based on the determined reference value.

The LED driving module may control magnitudes of the LED driving current to be different from each other in each driving section.

The LED driving module may control the LED driving current to be sequentially increased from a first LED driving current for a first stage driving section to an n-th LED driving current for an n-th stage driving section.

The dimmer may be a TRIAC dimmer.

The dimmable AC driven LED illuminating apparatus may further include a trigger current maintaining circuit connected between the TRIAC dimmer and the rectifying unit to allow a TRIAC trigger current to flow to an AC power input or a rectified voltage output or act as a dummy load.

The trigger current maintaining circuit may be a bleeder circuit.

The dimmable AC driven LED illuminating apparatus may further include an electromagnetic interference (EMI) filter connected between the dimmer and the rectifying unit and attenuating high frequency noise of the phase-controlled AC power.

The dimmable AC driven LED illuminating apparatus may further include a surge protecting unit connected to an output terminal of the rectifying unit and protecting a circuit.

The dimming level detecting unit may average the driving voltage to detect the dimming level.

The dimming level detecting unit may include an RC integration circuit.

The dimming level detecting unit may further include a voltage limiting circuit limiting the driving voltage to a maximum voltage or less.

The dimming level detecting unit may be embedded as an rms converter in the LED driving module to convert the driving voltage into a direct current (DC) signal.

The LED driving module may selectively enable and disable a dimming control function.

The LED driving module may include an automatic sensing circuit sensing whether or not a dimming circuit is connected to automatically select whether the dimming control function is enabled or disabled.

The dimmable AC driven LED illuminating apparatus may further include a driving voltage stabilizing unit decreasing and stabilizing the driving voltage supplied to the LED driving module.

DETAILED DESCRIPTION OF THE ILLUSTRATED EMBODIMENTS

Figure 1:
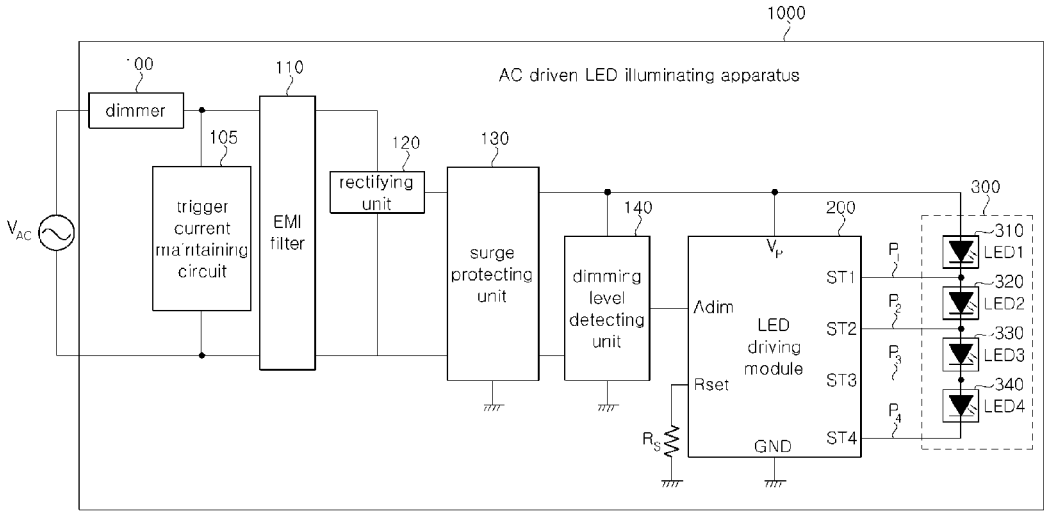
FIG. 1 is a schematic configuration diagram of a dimmable alternating current (AC) driven light emitting diode (LED) illuminating apparatus according to an exemplary embodiment of the present invention.

Exemplary embodiments of the present invention will be described in detail with reference to the accompanying drawings. These exemplary embodiments will be described in detail for those skilled in the art in order to practice the present invention. It should be appreciated that various exemplary embodiments of the present invention are different from each other, but do not have to be exclusive. For example, specific shapes, structures, and characteristics described in the present specification may be implemented in another exemplary embodiment without departing from the spirit and the scope of the present invention in is connection with an exemplary embodiment. In addition, it should be understood that a position and an arrangement of individual components in each disclosed exemplary embodiment may be changed without departing from the spirit and the scope of the present invention. Therefore, a detailed description to be described below should not be construed as being restrictive. In addition, the scope of the present invention is defined only by the accompanying claims and their equivalents if appropriate. Similar reference numerals will be used to describe the same or similar functions throughout the accompanying drawings.

Hereinafter, exemplary embodiments of the present invention will be described in detail with reference to the accompanying drawings so that those skilled in the art may easily practice the present invention.

In an exemplary embodiment of the present invention, a 'light emitting diode (LED) group' means a set of LEDs in which a group of LEDs (or a plurality of light emitting cells) are connected in series, parallel, or series and parallel with each other, such that operations of the LEDs are controlled as one unit, depending on the control of an LED driving module (that is, the LEDs are turned on/off together with each other).

In addition, a 'LED driving module' means a module receiving an alternating current (AC) voltage to drive and control the LEDs, and although an exemplary embodiment in which the driving of the LEDs is controlled using a rectified voltage will be mainly described in the present specification, the present invention is not limited thereto, but should be generally and widely interpreted.

Further, a 'first forward voltage level (Vf1)' means a threshold voltage level that may drive a first LED group, a 'second forward voltage level (Vf2)' means a threshold voltage level that may drive first and second LED groups connected in series with each other, and a is 'third forward voltage level (Vf3)' means a threshold voltage level that may drive first to third LED groups connected in series with each other. That is, 'an n-th forward voltage level (Vfn)' means a threshold voltage level that may drive first to n-th LED groups connected in series with each other. Meanwhile, forward voltage levels of each LED group may be the same as each other, or different from each other, depending on the number/characteristics of LEDs configuring the corresponding LED group.

Further, a 'sequential driving scheme' means a driving scheme in which LED groups sequentially emit light depending on an increase in an applied input voltage and are sequentially turned off depending on a decrease in an applied input voltage, in the LED driving module receiving an input voltage of which a magnitude is changed over time to drive the LEDs.

Further, a 'first stage driving section' means a time period in which only a first LED group emits light, and a 'second stage driving section' means a time period in which only first and second LED groups emit light. Therefore, an 'n-th stage driving section' means a time period in which all of first to n-th LED groups emit light, but LED groups following an n+1-th LED group do not emit light.

Further, terms such as V1, V2, V3, . . . , t1, t2, . . . , T1, T2, T3, and the like, are used in order to represent any specific voltage, specific point in time, specific temperature, and the like, and are not used in order to represent absolute values. Instead, these terms are used in order to distinguish relative values from each other.

Figure 2:
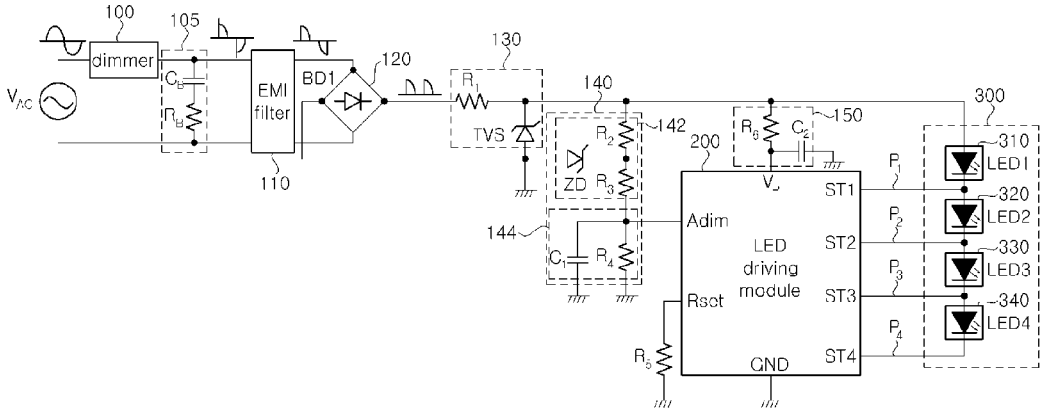
FIG. 2 is a circuit diagram of the dimmable AC driven LED illuminating apparatus according to an exemplary embodiment of the present invention.

FIG. 1 is a schematic configuration diagram of a dimmable alternating current (AC) driven light emitting diode (LED) illuminating apparatus 1000 (hereinafter, referred to as an LED illuminating apparatus) according to an exemplary embodiment of the present invention, and FIG. 2 is a circuit diagram of the dimmable AC driven LED illuminating apparatus 1000. Hereinafter, a configuration and a function of the LED illuminating apparatus 1000 will be generally described with reference to FIGS. 1 and 2.

First, the LED illuminating apparatus 1000 may be configured to include a dimmer 100, an electromagnetic interference (EMI) filter 110, a rectifying unit 120, a surge protecting unit 130, a dimming level detecting unit 140, an LED driving module 200, and an LED light-emitting unit 300.

The dimmer 100 may be configured to receive an AC voltage ($V_{AC}$) from an AC voltage source and control the received AC voltage ($V_{AC}$) depending on a dimming level selected depending on a manipulation of a user, to generate and output the controlled AC power. The dimmer 100 may be one of a TRIAC dimmer controlling a phase of AC power using a TRIAC, a pulse width modulation (PWM) dimmer, an analog voltage dimmer changing an AC voltage, and dimmers equivalent thereto. That is, it is to be noted that the dimmer 100 may be any dimmer that may control the AC power depending on the selected dimming level to generate/output the controlled AC power and allow the selected dimming level to be detected by a dimming level detecting unit 140 described below, from the AC power controlled by the dimmer 100 (or a controlled rectified voltage generated by full-wave-rectifying the controlled AC power). Hereinafter, although the present invention will be described based on an exemplary embodiment in which the TRIAC dimmer is adopted as the dimmer 100, it will be obvious that the scope of the present invention is not limited thereto, but also includes exemplary embodiments in which one of various dimmers as described above is used as long as it includes the gist of the present invention.

In the case in which the dimmer 100 is implemented using the TRIAC dimmer as described above, the dimmer 100 may be configured to control the phase of the input AC power is based on the dimming level selected by a user (or selected automatically) to generate and output the phase-controlled AC voltage. Since the TRAIC dimmer adopts the technology well-known in the art, a detailed description thereof will be omitted. Although the dimmer 100 is included in one apparatus has been shown in FIGS. 1 and 2, it is for convenience of explanation and understanding, and it is to be understood that the dimmer 100 may be actually installed spaced apart from the LED illuminating apparatus 1000 and be connected to the LED illuminating apparatus 100 by a conducting wire.

In the case in which the dimmer 100 is configured using the TRIAC dimmer, a TRIAC trigger current should be processed. Therefore, the LED illuminating apparatus 1000 may further include a trigger current maintaining circuit 105 connected between the dimmer 100 and the rectifying unit 120, to allow the TRIAC trigger current to flow to an AC power input or a rectified voltage output, or act as a dummy load. In FIG. 2, an example in which the trigger current maintaining circuit 105 is implemented by a bleeder circuit including a bleeder capacitor $C_B$ and a bleeder resistor $R_B$ connected in series with the bleeder capacitor is shown. However, it will be obvious to those skilled in the art that the trigger current maintaining circuit 105 is not limited to the circuit shown in FIG. 2, but may be one of various known voltage stabilizing circuits adopted as needed.

In addition, as described above, in the case in which the TRIAC dimmer is used as the dimmer 100, high frequency noise occurs at a turn-on point in time, due to a physical property of the TRIAC device. Since the high frequency noise may cause damage to the LED illuminating apparatus 1000, it is generally preferable to remove the high frequency noise. Therefore, the EMI filter 110 is provided between an output terminal of the dimmer 100 and an input terminal of the rectifying unit 120. The EMI filter 110 serves to attenuate the high is frequency noise of the phase-controlled AC voltage output from the dimmer 100. Since the EMI filter 110 adopts the technology well-known in the art, a detailed description thereof will be omitted.

The rectifying unit 120 serves to rectify the phase-controlled AC voltage output from the dimmer 100 to generate a driving voltage ($V_P$) and output the generated driving voltage ($V_P$). As the rectifying unit 120, one of various known rectifying circuits such as a full-wave rectifying circuit, a half-wave rectifying circuit, and the like, may be used. The driving voltage ($V_P$) output from the rectifying unit 120 is output to the dimming level detecting unit 140, the LED driving module 200, and the LED light-emitting unit 300. In FIG. 2, the rectifying unit 120 is configured using a bridge full-wave rectifying circuit including four diodes.

The LED illuminating apparatus 1000 may further include the surge protecting unit 130 to protect the LED driving module 200 and the LED light-emitting unit 300 from an over-voltage and/or an over-current. The surge protecting unit 130 is connected to an output terminal of the rectifying unit 120 and is configured to serve to protect components of the LED illuminating apparatus 1000 from the over-voltage and/or the over-current. In FIG. 2, the surge protecting unit 130 includes a resistor $R_1$ and a transient voltage suppression (TVS) diode TVS. The surge protecting unit 130 is not limited to a circuit shown in FIG. 2, but may be one of various known surge protecting circuits adopted as needed.

The LED light-emitting unit 300 may include a plurality of LED groups, and the LED groups included in the LED light-emitting unit 300 may sequentially emit light and may be sequentially turned off, depending on a control of the LED driving module 200. Although the LED light-emitting unit 300 including a first LED group 310, a second LED group 320, a third LED group 330, and a fourth LED group 340 is shown in FIGS. 1 and 2, the number of LED is groups included in the LED light-emitting unit 300 may be variously changed as needed.

In addition, according to other exemplary embodiments, the first LED group 310, the second LED group 320, the third LED group 330, and the fourth LED group 340 may have the same forward voltage level or different forward voltage levels, respectively. For example, in the case in which the first LED group 310, the second LED group 320, the third LED group 330, and the fourth LED group 340 include different numbers of LED devices, respectively, the first LED group 310, the second LED group 320, the third LED group 330, and the fourth LED group 340 will have different forward voltage levels. On the other hand, for example, in the case in which the first LED group 310, the second LED group 320, the third LED group 330, and the fourth LED group 340 include the same number of LED devices, the first LED group 310, the second LED group 320, the third LED group 330, and the fourth LED group 340 will have the same forward voltage level.

The dimming level detecting unit 140 may be configured to receive the driving voltage ($V_P$) output from the rectifying unit 120, detect a currently selected dimming level based on the received driving voltage ($V_P$), and output the detected dimming level signal to the LED driving module 200. In more detail, the dimming level detecting unit 140 may be configured to average the driving voltage ($V_P$), of which a level is changed over time, to detect the dimming level. As described above, since the dimmer 100 is configured to cut the phase of the AC voltage ($V_{AC}$) depending on the selected dimming level, in the case in which the driving voltage ($V_P$) is averaged, the currently selected dimming level may be detected. In the case in which the dimming level detecting unit 140 is configured in this scheme, a dimming level signal Adim corresponding to a specific dimming level output from the dimming level detecting unit 140 may be a DC signal having a constant voltage value. For example, in the case in which the dimming is level is 100%, the dimming level signal Adim corresponding to the dimming level is 2V, in the case in which the dimming level is 90%, the dimming level signal Adim corresponding to the dimming level is 1.8V, and in the case in which the dimming level is 50%, the dimming level signal Adim corresponding to the dimming level is 1V. A value and a range of the dimming level signal Adim corresponding to the specific dimming level may be changed by appropriately selecting values of circuit devices configuring the dimming level detecting unit 140. In FIG. 2, the dimming level detecting unit 140 includes an RC integration circuit 144 including one resistor $R_4$ and one capacitor $C_1$. Here, the resistor $R_4$ is to set a minimum LED driving current $I_{LED}$ limit. Therefore, since the minimum LED driving current $I_{LED}$ limit is set through the resistor $R_4$, a minimum LED driving current $I_{LED}$ may be maintained even at the lowest dimming level, such that dimming characteristics of the LED illuminating apparatus 1000 may be improved.

The dimming level detecting unit 140 may further include a voltage limiting circuit 142 to limit the received driving voltage ($V_P$) to a maximum voltage or less. Generally, a maximum voltage level of the driving voltage ($V_P$) supplied to the LED light-emitting unit 300 is significantly high. Therefore, in the case in which the dimming level is detected using the driving voltage ($V_P$) and the detected dimming level is input to the LED driving module 200, there is a risk that the LED driving module 200 will be damaged. Therefore, in order to solve this problem, the dimming level detecting unit 140 may include the voltage limiting circuit 142 to limit the received driving voltage ($V_P$) to a maximum voltage (for example, 15V) or less. In FIG. 2, the voltage limiting circuit 142 is implemented using resistors $R_2$ and $R_3$ and a Zener diode ZD. Here, the voltage limiting circuit 142 serves as a maximum dimming suppressing circuit to decrease the tolerance of the Zener diode ZD.

The dimming level detecting unit 140 will be described in detail with reference to FIG. 2. The dimming level detecting unit 140 may include three resistors $R_2$, $R_3$, and $R_4$, one capacitor $C_1$, and one Zener diode ZD. Here, the resistor $R_4$ is to set the minimum LED driving current $I_{LED}$ limit, and the resistors $R_2$ and $R_3$ and the Zener diode ZD serve as a maximum dimming suppressing circuit.

Figure 7:
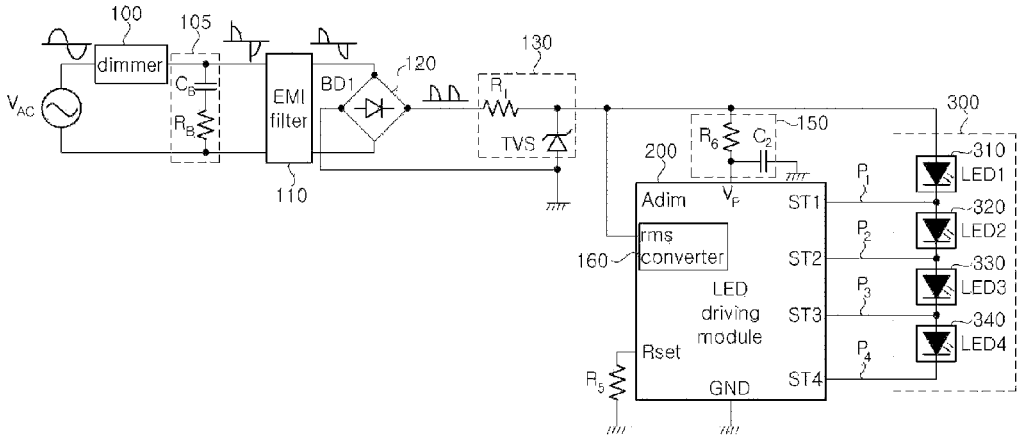
FIG. 7 is a circuit diagram of the dimmable AC driven LED illuminating apparatus according to an exemplary embodiment.

FIG. 7 is a circuit diagram of the dimmable AC driven LED illuminating apparatus according to an exemplary embodiment. Although an exemplary embodiment in which the dimming level detecting unit 140 implemented as a separate circuit outside the LED driving module 200 has been shown in FIGS. 1 and 2, the dimming level detecting unit 140 may also be implemented by an rms converter 160 and may be embedded in the LED driving module 200 in other exemplary embodiments, as shown in FIG. 7.

The LED driving module 200 is configured to receive the driving voltage ($V_P$) output from the rectifying unit 120, determine the magnitude of the received driving voltage ($V_P$), and control sequential driving of the LED light-emitting unit 300 (more specifically, each of the LED groups 310 to 340 included in the LED light-emitting unit 300) depending on the determined magnitude of the driving voltage ($V_P$). Generally, the maximum voltage level of the driving voltage ($V_P$) supplied to the LED light-emitting unit 300 is significantly high. Therefore, in the case of using the driving voltage ($V_P$) as it is, the LED driving module 200 may be damaged. In order to prevent this problem, the LED illuminating apparatus 1000 may include a driving voltage stabilizing unit 150 disposed between a driving voltage ($V_P$)

input node and a driving voltage input terminal of the LED illuminating apparatus 1000. Referring to FIG. 2, the driving voltage stabilizing unit 150 may include a resistor $R_6$ to reduce the driving voltage ($V_P$), and a capacitor $C_2$ to stabilize the driving voltage ($V_P$). The driving voltage stabilizing unit 150 is not limited to the configuration shown in FIG. 2, but one of various known circuits may be adopted as needed.

In addition, the LED driving module 200 may be configured to receive the dimming level signal Adim output from the dimming level detecting unit 140 and limit a maximum value of the LED driving current $I_{LED}$, based on the received dimming level signal Adim. In more detail, the LED driving module 200 may be configured to determine an LED driving current reference value (Adim_$I_{ref}$) that is dimming-controlled in proportion to the received dimming level signal Adim and perform a constant current control on the LED driving current $I_{LED}$, based on the determined dimming-controlled LED driving current reference value (Adim_$I_{ref}$). In the case in which a dimming control is performed in this scheme, a light emitting time of the LED light-emitting unit 300 is controlled by the driving voltage ($V_P$) of which a phase is controlled (that is, of which a phase is cut depending on the dimming level), and a magnitude of the LED driving current $I_{LED}$ is controlled based on the detected dimming level, thereby displaying smooth dimming characteristics over an entire section of the dimming level. In addition, through the above-mentioned configuration, a non-uniform fluctuation phenomenon may be removed. A detail configuration and function of the LED driving module 200 will be described below with reference to FIGS. 3 to 5.

Figure 8:
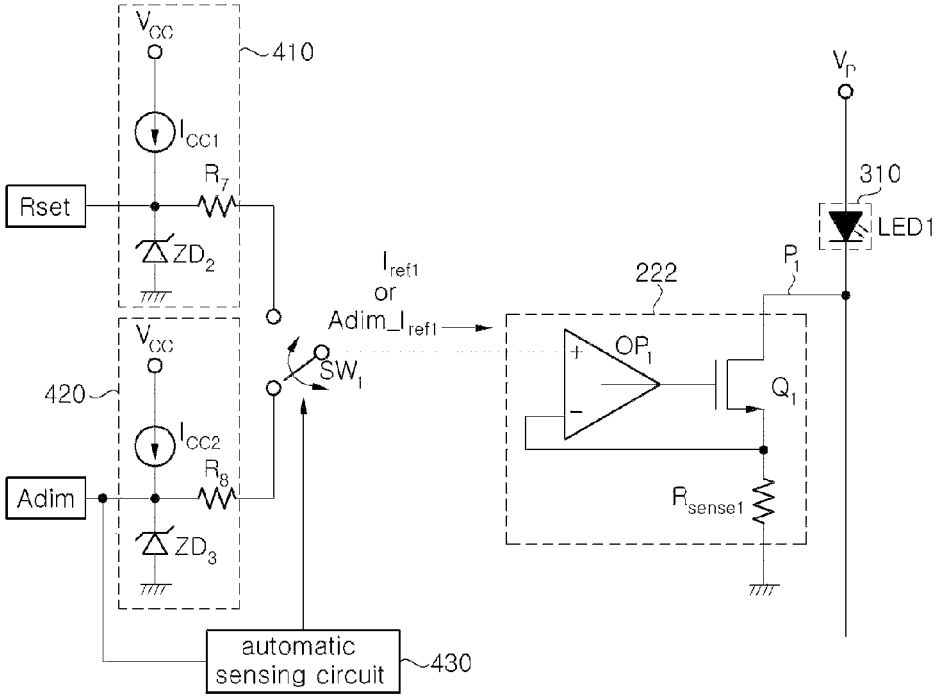
FIG. 8 is a circuit diagram of an LED group driving unit according to an exemplary embodiment.

FIG. 8 is a circuit diagram of an LED group driving unit according to an exemplary embodiment. The LED driving module 200 may be configured to selectively enable and disable a dimming control function. The LED driving module 200 may be configured so that it is determined through jumper setting whether or not the dimming control function is enabled. In addition, according to other exemplary embodiments, as shown in FIG. 8, an automatic sensing circuit 430 to automatically select whether or not the dimming control is function is enabled may be included in the LED driving module 200. The automatic sensing circuit 430 is configured to judge whether a dimming circuit has been connected and automatically select whether the dimming control function is enabled, depending on whether the dimming circuit has been connected. The automatic sensing circuit 430 may be configured to detect whether, for example, a TRIAC dimming voltage is present, enable the dimming control function in the case in which the TRIAC dimming voltage is present, and disable the dimming control function in the case in which the TRIAC dimming voltage is not present. In addition to the automatic sensing circuit 430, various automatic sensing circuits may be used.

In addition, in FIG. 2, a maximum LED driving current setting resistor $R_5$ is a resistor to set a maximum LED driving current limit when the dimming control function is disabled or when a dimming level is 100%. Therefore, a maximum LED driving current reference value NO may be changed by changing a resistance value of the maximum LED driving current setting resistor $R_5$. Therefore, when considering this together with the dimming level detecting unit 140 described above, in the LED illuminating apparatus 1000, a minimum LED driving current limit may be set through the resistor $R_4$, and the maximum LED driving current limit may be set through the resistor $R_5$.

Figure 3:
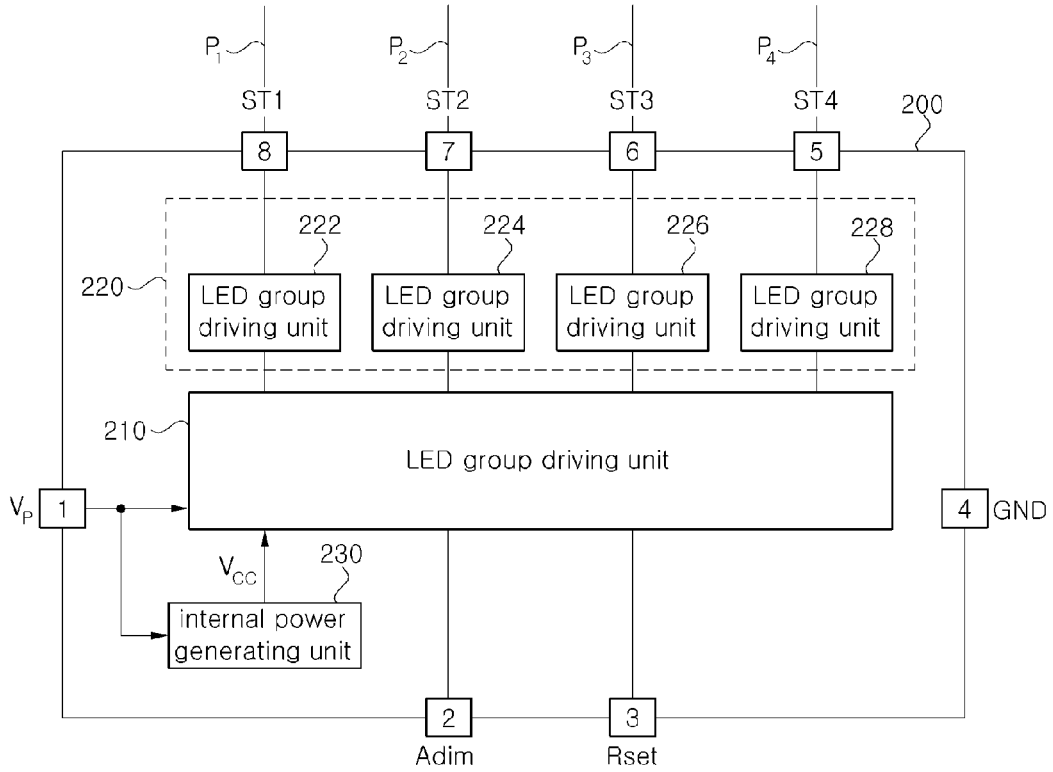
FIG. 3 is a configuration diagram of an LED driving module according to an exemplary embodiment of the present invention.
Figure 4:
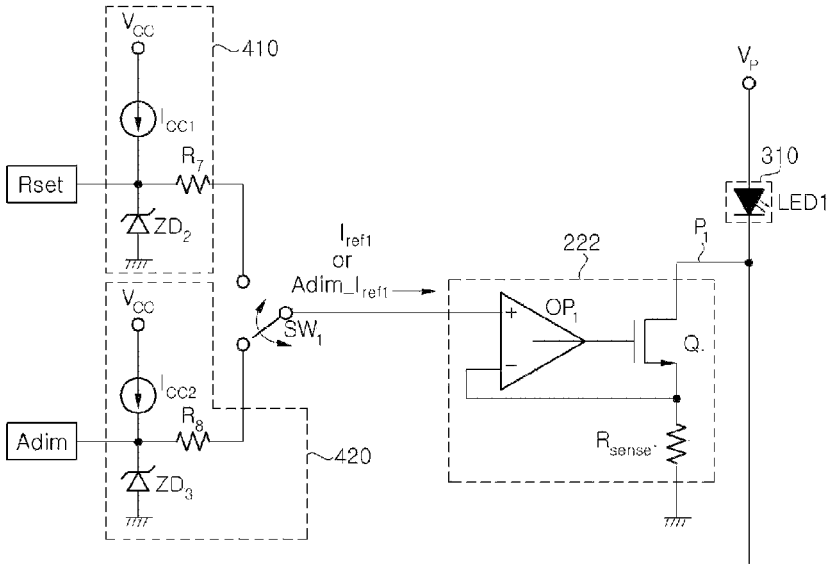
FIG. 4 is a circuit diagram of an LED group driving unit according to an exemplary embodiment of the present invention.

FIG. 3 is a configuration diagram of an LED driving module 200 according to an exemplary embodiment of the present invention; and FIG. 4 is a circuit diagram of an LED group driving unit according to an exemplary embodiment of the present invention. Hereinafter, a configuration and a function of the LED driving module 200 and a driving control process of the LED illuminating apparatus 1000 will be described with reference to FIGS. 3 and 4.

As shown in FIG. 3, the LED driving module 200 may include LED group driving units 220, a LED driving control unit 210, and an internal power generating unit 230, in order to is drive and control the LED groups 310 to 340. In addition, the LED driving module 200 may be implemented as an integrated circuit (IC) and may include a driving voltage input terminal VP to which the driving voltage $V_P$ is input, a dimming level signal input terminal Adim to which the dimming level signal Adim is input, a connection terminal Rset to which a maximum driving current setting resistor $R_S$ is connected, a ground terminal GND to which a ground is connected, a connection terminal ST4 to which a fourth current path $P_4$ connected to a cathode terminal of the fourth LED group 340 is connected, a connection terminal ST3 to which a third current path $P_3$ between a cathode terminal of the third LED group 330 and an anode terminal of the fourth LED group 340 is connected, a connection terminal ST2 to which a second current path $P_2$ between a cathode terminal of the second LED group 320 and an anode terminal of the third LED group 330 is connected, and a connection terminal ST1 to which a first current path $P_1$ between a cathode terminal of the first LED group 310 and an anode terminal of the second LED group 320 is connected, as shown in FIG. 3. Although the LED driving module 200 includes eight terminals as shown in FIG. 3, the number of terminals may be changed as needed.

The internal power generating unit 230 is configured to decrease and smooth the driving voltage $V_P$ to generate and supply internal DC power $V_{CC}$ for driving the LED driving module 200. The internal power generating unit 230 may be implemented by a smoothing circuit including a resistor and a capacitor.

The LED driving control unit 210 is configured to judge a voltage level of the driving voltage $V_P$ input from the rectifying unit 120 and control sequential driving of the LED groups 310 to 340, depending on the voltage level of the driving voltage V. In more detail, the LED driving control unit 210 performs a control operation, so that only the first current path $P_1$ is connected and the other current paths are opened, such that only the first LED group 310 emits is light, in a first stage operation section in which the voltage level of the driving voltage $V_P$ is between a first forward voltage level Vf1 and a second forward voltage level Vf2. In addition, the LED driving control unit 210 performs a control operation, so that only the second current path $P_2$ is connected and the other current paths are opened, such that the first and second LED groups 310 and 320 emit light, in a second stage operation section, in which the voltage level of the driving voltage $V_P$ is between the second forward voltage level Vf2 and a third forward voltage level Vf3. Similarly, the LED driving control unit 210 performs a control operation, so that only the third current path $P_3$ is connected and the other current paths are opened, such that the first to third LED groups 310 to 330 emit light, in a third stage operation section, in which the voltage level of the driving voltage $V_P$ is between the third forward voltage level Vf3 and a fourth forward voltage level Vf4. In addition, the LED driving control unit 210 performs a control operation, so that only the fourth current path $P_4$ is connected and the other current paths are opened, such that all of the first to fourth LED groups 310 to 340 emit light, in a fourth stage operation section, in which the voltage level of the driving voltage $V_P$ is the fourth forward voltage level Vf4 or more. Therefore, the LED driving control unit 210 is configured to control the sequential driving of the LED groups 310 to 340 depending on the voltage level of the driving voltage $V_P$ through the scheme described above.

The LED driving control unit 210 may be configured to determine the LED driving current reference value $I_{ref}$ that becomes a reference of a constant current control depending on the input dimming level signal Adim and output the determined LED driving current reference value $I_{ref}$ to the LED group driving units 220, in order to perform the dimming control function. Here, the LED driving current reference value $I_{ref}$ output from the LED driving control unit 210 becomes a reference value for performing a constant current control on the LED is driving current $I_{LED}$ in the LED group driving units 220. Here, more preferably, the LED driving control unit 210 may be configured to approximate first to fourth LED driving currents $I_{LED1}$ to $I_{LED4}$ to a sine wave, by setting a first driving current reference value $I_{ref1}$, a second driving current reference value $I_{ref2}$, a third driving current reference value $I_{ref1}$, and a fourth driving current reference value $I_{ref4}$ to be different from each other. As such, a waveform of the LED driving current may approximate to a waveform of the driving voltage $V_P$, in order to improve power factor (PF) and total harmonic distortion (THD) characteristics. That is, a reference value may be set to sequentially rise from the first driving current reference value $I_{ref1}$ of the first stage driving section, to the fourth driving current reference value $I_{ref4}$ of the fourth stage driving section. When it is assumed that a dimming level of 100% is selected for explanation, the fourth driving current reference value $I_{ref4}$ may be set to 100 mA, the third driving current reference value $I_{ref3}$ may be set to any value between 80 to 95 mA, which is 80 to 95% of the fourth driving current reference value $I_{ref4}$, the second driving current reference value $I_{ref2}$ may be set to any value between 65 to 80 mA, which is 65 to 80% of the fourth driving current reference value $I_{ref4}$, and the first driving current reference value $I_{ref1}$ may be set to any value between 30 to 65 mA, which is 30 to 65% of the fourth driving current reference value $I_{ref4}$.

Since the case in which the dimming level of 100% is selected has been assumed in the above-mentioned example, as the dimming level is changed, the first to fourth driving current reference values $I_{ref1}$ to $I_{ref4}$ will be determined depending on the changed dimming level, and newly determined first to fourth driving current reference values $I_{ref1'}$ to $I_{ref4'}$ will be output. In another exemplary embodiment, the fourth driving current reference value $I_{ref4}$ may be a maximum LED driving current $I_{LEDmax}$ set depending on the resistance value of the maximum LED driving current setting resistor $R_5$, and the first driving current reference value $I_{ref1}$, the is second driving current reference value $I_{ref2}$, and the third driving current reference value $I_{ref3}$ may be reference values obtained by decreasing the fourth driving current reference value $I_{ref4}$ in preset decrease ratios, respectively. Hereinafter, a driving current reference value in the case in which the dimming control function is enabled and the dimming level is not 100% is called a dimming-controlled driving current reference value (Adim_$I_{ref}$), in order to be distinguished from a maximum driving current reference value ($I_{ref}$), in the case in which the dimming level is 100% or in the case in which the dimming control function is disabled. A detailed description depending on a dimming level will be described below with reference to FIG. 5.

The LED group driving units 220 are configured to connect or open each of the current paths $P_1$ to $P_4$ depending on the control of the LED driving control unit 210 and perform a constant current control on the LED driving current $I_{LED}$. As shown in FIG. 3, a first LED group driving unit 222 is connected between the first and second LED groups 310 and 320 through the first current path $P_1$ and is configured to connect or open the first current path $P_1$ depending on a control of the LED driving control unit 210. In addition, a second LED group driving unit 224 is connected between the second and third LED groups 320 and 330 through the second current path $P_2$ and is configured to connect or open the second current path $P_2$ depending on a control of the LED driving control unit 210. Similarly, a third LED group driving unit 226 is connected between the third and fourth LED groups 330 and 340 through the third current path $P_3$ and is configured to connect or open the third current path $P_3$ depending on a control of the LED driving control unit 210. Finally, a fourth LED group driving unit 228 is connected to the fourth LED group 340 through the fourth current path $P_4$ and is configured to connect or open the fourth current path $P_4$ depending on a control of the LED driving control unit 210.

The LED group driving units 222 to 228 are configured to perform a constant is current control function in addition to turn on/off control functions of the paths $P_1$ to $P_4$, respectively. FIG. 4 is a circuit diagram of a first LED group driving unit 222, according to an exemplary embodiment of the present invention. Although a configuration of the first LED group driving unit 222 has been shown in FIG. 4 for convenience of explanation and understanding, the second to fourth LED group driving units 224 to 228 have the same configuration as that of the first LED group driving unit 222. A configuration and a function of the first LED group driving unit 222 will be described in detail with reference to FIG. 4.

Referring to FIG. 4, the first LED group driving unit 222 may include one electronic switching device $Q_1$, one sensing resistor $R_{sense1}$, and one differential amplifier $OP_1$. In addition, the first LED group driving unit 222 may be connected to a switch $SW_1$ to thereby be connected to a pull-up resistor unit 410 connected to an Rset terminal or a pull-up resistor unit 420 connected to an Adim terminal. The switch $SW_1$ may be controlled by the automatic sensing circuit (not shown) as described above. That is, in the case in which an external dimming circuit is not sensed or the dimming control function is disabled depending on the jumper setting, the automatic sensing circuit controls the switch $SW_1$ to connect the first LED group driving unit 222 to the pull-up resistor unit 410 connected to the Rset terminal. In the case in which the external dimming circuit is sensed, the automatic sensing circuit controls the switch $SW_1$ to connect the first LED group driving unit 222 to the pull-up resistor unit 420 connected to the Adim terminal.

The electronic switching device $Q_1$ is configured to be turned on depending on a control of the LED driving control unit 210 to connect the first current path $P_1$ and be turned off depending on a control of the LED driving control unit 210 to open the first current path $P_1$. As the electronic switching device $Q_1$, a bipolar junction transistor (BJT), a field effect transistor is (FET), or the like, may be used, and a kind of electronic switching device $Q_1$ is not limited. In FIG. 4, the electronic switching device $Q_1$ is implemented by a P-type metal oxide semiconductor field effect transistor (MOSFET).

A maximum first driving current reference value $I_{ref1}$ output from the LED driving control unit 210 or a first driving current reference value Adim_$I_{ref1}$ dimming-controlled is input as a reference value to a non-inverting input terminal of the operational amplifier $OP_1$, and a voltage value across the sensing resistor $R_{sense1}$ (that is, a voltage value corresponding to the first LED driving current $I_{LED1}$ flowing through the first current path $P_1$) is input to an inverting input terminal of the operational amplifier OP" The operational amplifier $OP_1$ compares a voltage input through the non-inverting input terminal and a voltage input through the inverting input terminal and controls a gate voltage of the electronic switching device $Q_1$ so that the first LED driving current $I_{LED1}$ may be maintained as an input reference value, depending on a result of the comparison. As such, a constant current control function may be performed.

The second to fourth LED group driving units 224 to 228 may also include an electronic switching device, a sensing resistor, and a differential amplifier, similar to the first LED group driving unit 222.

Therefore, the second LED group driving unit 224 connects or opens the second current path $P_2$ and performs a constant current control, so that the second LED driving current $I_{LED2}$ may be maintained as an input reference value using a maximum second driving current reference value $I_{ref2}$ output from the LED driving control unit 210 or a second driving current reference value Adim_$I_{ref2}$ dimming-controlled as the reference value. Similarly, the third LED group driving unit 226 connects or opens the third current path $P_3$ and performs a constant current control so that the third LED driving current $I_{LED3}$ may be maintained as an input is reference value using a maximum third driving current reference value $I_{ref1}$ output from the LED driving control unit 210 or a third driving current reference value Adim_$I_{ref1}$ dimming-controlled as the reference value. Finally, the fourth LED group driving unit 228 connects or opens the fourth current path $P_4$ and performs a constant current control so that the fourth LED driving current $I_{LED4}$ may be maintained as an input reference value using a maximum fourth driving current reference value $I_{ref4}$ output from the LED driving control unit 210 or a fourth driving current reference value Adim_$I_{ref4}$ dimming-controlled as the reference value.

Figure 5A:
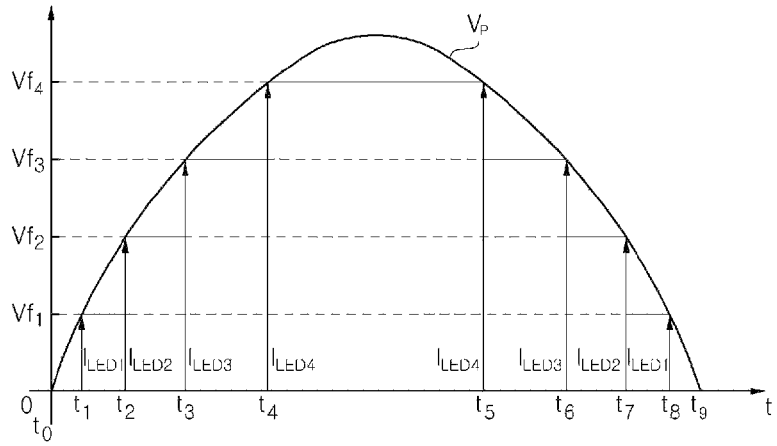
FIGS. 5A, 5B, and 5C are waveform diagrams showing a relationship between an LED driving voltage and driving current depending on a dimming level according to an exemplary embodiment of the present invention.
Figure 5B:
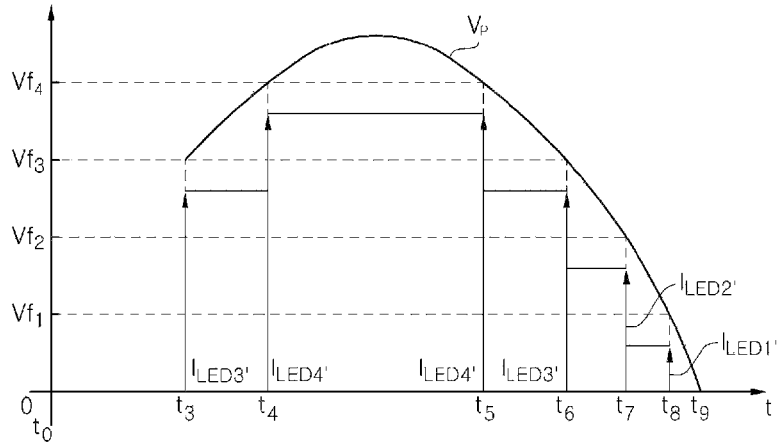
Figure 5C:
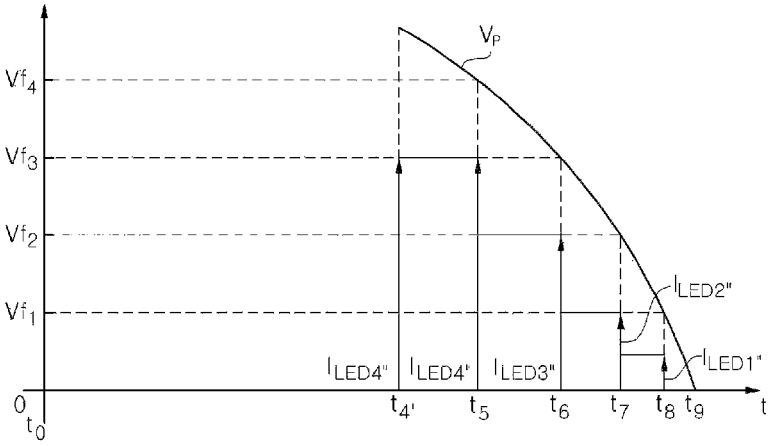

FIGS. 5A to 5C are waveform diagrams showing a relationship between an LED driving voltage and an LED driving current depending on a dimming level based on a positive half period of an AC voltage, in the LED illuminating apparatus 1000, according to an exemplary embodiment of the present invention. A dimming control process performed in the LED illuminating apparatus 1000 will be described in detail with reference to FIGS. 2, 3, and 5A-5C.

First, in FIG. 5A, waveforms of a driving voltage $V_P$ and an LED driving current $I_{LED}$ in the case in which a dimming level is set to 100% are shown. The following Table 1 is a table showing a relationship among a driving section, operation states of LED groups, and a LED driving current in this case.

TABLE 1

| Driving Section | LED Group 1 | LED Group 2 | LED Group 3 | LED Group 4 | $I_{LED}$ |
|---|---|---|---|---|---|
| t1~t2 | ON | OFF | OFF | OFF | $I_{ref1}$ |
| t2~t3 | ON | ON | OFF | OFF | $I_{ref2}$ |
| t3~t4 | ON | ON | ON | OFF | $I_{ref3}$ |
| t4~t5 | ON | ON | ON | ON | $I_{ref4}$ |
| t5~t6 | ON | ON | ON | OFF | $I_{ref3}$ |
| t6~t7 | ON | ON | OFF | OFF | $I_{ref2}$ |
| t7~t8 | ON | OFF | OFF | OFF | $I_{ref1}$ |

As shown in FIG. 5A, since the selected dimming level is 100%, a phase control did not occur for an input AC power $V_{AC}$, such that a phase control did not occur for the driving voltage V. First, in the case of an exemplary embodiment shown in FIG. 5A, the dimming level detecting unit 140 averages the driving voltage $V_P$ to detect a dimming level and outputs the detected dimming level signal Adim to the LED driving module 200. Here, the detected is dimming level is 100%, and the dimming level signal Adim input to the LED driving module 200 is a constant voltage signal corresponding to the dimming level of 100%. Therefore, in this case, the LED illuminating apparatus 1000 is controlled in the same scheme as a general four-stage sequential driving scheme.

Referring to FIG. 5A, at a point in time t1 in which a voltage level of the driving voltage $V_P$ rises over time to arrive at a first forward voltage level Vf1, the first LED group driving unit 222 is turned on depending on a control of the LED driving control unit 210, such that the first current path $P_1$ is connected. Therefore, the first LED driving current $I_{LED1}$ flows through the first current path $P_1$ and the first LED group 310 emits light. In this case, since the dimming level is 100%, the LED driving control unit 210 outputs the maximum first driving current reference value $I_{ref1}$ as a reference value for a constant current control to the first LED group driving unit 222, and the first LED group driving unit 222 detects the first LED driving current $I_{LED1}$ and performs a constant current control function, so that the first LED driving current $I_{LED1}$ may be maintained as the maximum first driving current reference value $I_{ref1}$.

Next, at a point in time t2 in which the voltage level of the driving voltage $V_P$ further rises over time to arrive at a second forward voltage level Vf2, the first LED group driving unit 222 is turned off and the second LED group driving unit 224 is turned on, depending on a control of the LED driving control unit 210, such that the second current path $P_2$ is connected. Therefore, the second LED driving current $I_{LED2}$ flows through the second current is path $P_2$ and the first and second LED groups 310 and 320 emit light. In this case, since the dimming level is 100%, the LED driving control unit 210 outputs the maximum second driving current reference value $I_{ref2}$ as a reference value for a constant current control to the second LED group driving unit 224, and the second LED group driving unit 224 detects the second LED driving current $I_{LED2}$ and performs a constant current control function so that the second LED driving current $I_{LED2}$ may be maintained as the maximum second driving current reference value $I_{ref2}$.

Similarly, at a point in time t3 in which the voltage level of the driving voltage $V_P$ further rises over time to arrive at a third forward voltage level Vf3, the second LED group driving unit 224 is turned off and the third LED group driving unit 226 is turned on, depending on a control of the LED driving control unit 210, such that the third current path $P_3$ is connected. Therefore, the third LED driving current $I_{LED3}$ flows through the third current path $P_3$ and the first to third LED groups 310 to 330 emit light. In this case, since the dimming level is 100%, the LED driving control unit 210 outputs the maximum third driving current reference value $I_{ref3}$ as a reference value for a constant current control to the third LED group driving unit 226, and the third LED group driving unit 226 detects the third LED driving current $I_{LED3}$ and performs a constant current control function, so that the third LED driving current $I_{LED3}$ may be maintained as the maximum third driving current reference value $I_{ref3}$.

In addition, at a point in time t4 in which the voltage level of the driving voltage $V_P$ further rises over time to arrive at a fourth forward voltage level Vf4, the third LED group driving unit 226 is turned off and the fourth LED group driving unit 228 is turned on, depending on a control of the LED driving control unit 210, such that the fourth current path $P_4$ is connected. Therefore, the fourth LED driving current $I_{LED4}$ flows through the fourth current path is $P_4$ and the first to fourth LED groups 310 to 340 emit light. In this case, since the dimming level is 100%, the LED driving control unit 210 outputs the maximum fourth driving current reference value $I_{ref4}$ as a reference value for a constant current control to the fourth LED group driving unit 228, and the fourth LED group driving unit 228 detects the fourth LED driving current $I_{LED4}$ and performs a constant current control function, so that the fourth LED driving current $I_{LED4}$ may be maintained as the maximum fourth driving current reference value $I_{ref4}$.

Meanwhile, at a point in time t5 in which the voltage level of the driving voltage $V_P$ arrives at a maximum value and then falls over time to become less than the fourth forward voltage level Vf4, the fourth LED group driving unit 228 is turned off and the third LED group driving unit 226 is turned on, depending on a control of the LED driving control unit 210, such that the third current path $P_3$ is connected. Therefore, the third LED driving current $I_{LED3}$ flows through the third current path $P_3$ and the first to third LED groups 310 to 330 emit the light. In this case, as described above, the third LED group driving unit 226 detects the third LED driving current $I_{LED3}$ and performs a constant current control function, so that the third LED driving current $I_{LED3}$ may be maintained as the maximum third driving current reference value $I_{ref3}$.

In addition, at a point in time t6 in which the voltage level of the driving voltage $V_P$ drops over time to become less than the third forward voltage level Vf3, the third LED group driving unit 226 is turned off and the second LED group driving unit 224 is turned on, depending on a control of the LED driving control unit 210, such that the second current path $P_2$ is connected. Therefore, the second LED driving current $I_{LED2}$ flows through the second current path $P_2$ and the first and second LED groups 310 and 320 emit the light. In this case, as described above, the second LED group driving unit 224 performs a constant current control function, so that the second LED driving current $I_{LED2}$ may be maintained as the maximum is second driving current reference value $I_{ref2}$.

Finally, at a point in time t7 in which the voltage level of the driving voltage $V_P$ drops over time to become less than the second forward voltage level Vf2, the second LED group driving unit 224 is turned off and the first LED group driving unit 222 is turned on, depending on a control of the LED driving control unit 210, such that the first current path $P_1$ is connected. Therefore, only the first LED group 310 emits the light, and the first LED group driving unit 222 performs a constant current control function so that the first LED driving current $I_{LED1}$ may be maintained as the maximum first driving current reference value $I_{ref1}$.

Next, in FIG. 5B, waveforms of a driving voltage $V_P$ and an LED driving current $I_{LED'}$ in the case in which a dimming level is set to be relatively high (for example, 80%) are shown. The following Table 2 is a table showing a relationship among a driving section, operation states of LED groups, and a LED driving current in this case.

TABLE 2

| Driving Section | LED Group 1 | LED Group 2 | LED Group 3 | LED Group 4 | $I_{LED'}$ |
|---|---|---|---|---|---|
| t3~t4 | ON | ON | ON | OFF | Adim_$I_{ref3}$ |
| t4~t5 | ON | ON | ON | ON | Adim_$I_{ref4}$ |
| t5~t6 | ON | ON | ON | OFF | Adim_$I_{ref3}$ |
| t6~t7 | ON | ON | OFF | OFF | Adim_$I_{ref2}$ |
| t7~t8 | ON | OFF | OFF | OFF | Adim_$I_{ref1}$ |

Referring to FIG. 5B, since the dimming level is 80%, a phase control occurred for the driving voltage $V_P$. Therefore, the voltage level of the driving voltage $V_P$ is maintained as 0V until the point in time t3. Therefore, the dimming level detecting unit 140 averages the driving voltage $V_P$ to detect a dimming level and outputs the detected dimming level signal Adim to the LED driving module 200. Here, the detected dimming level is 80%, and the dimming level signal Adim input to the LED driving module 200 is substantially a constant voltage signal corresponding to the dimming level of 80%. Therefore, the LED driving module 200 performs a dimming control based on the dimming level of 80%.

Since the voltage level of the driving voltage $V_P$ rises to the third forward voltage level Vf3 at the point in time t3, the third LED group driving unit 226 is turned on, such that the is third current path $P_3$ is connected. Therefore, a third LED driving current $I_{LED3'}$ flows through the third current path $P_3$ and the first to third LED groups 310 to 330 emit the light. In this case, since the dimming level is 80%, the LED driving control unit 210 outputs a third driving current reference value Adim_$I_{ref1}$ corresponding to the dimming level of 80% and dimming-controlled as a reference value for a constant current control to the third LED group driving unit 226. Here, the third driving current reference value Adim_$I_{ref3}$ corresponding to the dimming level of 80% and dimming-controlled may be determined in various schemes. In an exemplary embodiment, the third driving current reference value Adim_$I_{ref3}$ corresponding to the dimming level of 80% and dimming-controlled may be determined to be "a*(dimming level signal Adim corresponding to dimming level of 80%)*(maximum third driving current reference value $I_{ref3}$)" (here, a indicates any constant allowing a light output or flux of the LED illuminating apparatus 1000 to become 80% of a maximum light output or flux).

Alternatively, in another exemplary embodiment, the third driving current reference value Adim_$I_{ref1}$ corresponding to the dimming level of 80% and dimming-controlled may be determined to be "b*0.8*(maximum third driving current reference value $I_{ref3}$)" (here, b indicates any constant allowing a light output or flux of the LED illuminating apparatus 1000 to become 80% of a maximum light output or flux). Alternatively, in still another exemplary embodiment, an equation or a graph for third driving current reference values Adim_$I_{ref3}$ corresponding to a dimming level and dimming-controlled may be stored, and a third driving current reference value Adim_$I_{ref3}$ dimming-controlled may be determined using the equation or is the graph depending on a detected dimming level. The third driving current reference value Adim_$I_{ref3}$ dimming-controlled may be determined in various schemes other than the above-mentioned schemes, and it will be obvious to those skilled in the art that various modifications and alterations may be made without departing from the scope of the present invention as long as the third driving current reference value Adim_$I_{ref3}$ dimming-controlled is determined in proportion to the dimming level. A first driving current reference value Adim_$I_{ref1}$ dimming-controlled, a second driving current reference value Adim_$I_{ref2}$ dimming-controlled, and a fourth driving current reference value Adim_$I_{ref4}$ dimming-controlled may also be determined in the same scheme as the above-mentioned scheme.

At the point in time t4 in which the voltage level of the driving voltage $V_P$ further rises over time to arrive at the fourth forward voltage level Vf4, the third LED group driving unit 226 is turned off and the fourth LED group driving unit 228 is turned on, depending on a control of the LED driving control unit 210, such that the fourth current path $P_4$ is connected. Therefore, a fourth LED driving current $I_{LED4'}$ flows through the fourth current path $P_4$ and the first to fourth LED groups 310 to 340 emit the light. In this case, the LED driving control unit 210 outputs the fourth driving current reference value Adim_$I_{ref4}$ corresponding to the dimming level of 80% and dimming-controlled to the fourth LED group driving unit 228, and the fourth LED group driving unit 228 detects the fourth LED driving current $I_{LED4'}$ and performs a constant current control function so that the fourth LED driving current $I_{LED4'}$ may be maintained as the fourth driving current reference value Adim_$I_{ref4}$ dimming-controlled.

At the point in time t5 in which the voltage level of the driving voltage $V_P$ arrives at the maximum value and then falls over time to become less than the fourth forward voltage level Vf4, the fourth LED group driving unit 228 is turned off and the third LED group driving is unit 226 is turned on, depending on a control of the LED driving control unit 210, such that the third current path $P_3$ is connected. Therefore, a third LED driving current $I_{LED3'}$ flows through the third current path $P_3$ and the first to third LED groups 310 to 330 emit the light. In this case, as described above, the third LED group driving unit 226 detects the third LED driving current $I_{LED3'}$ and performs a constant current control function, so that the third LED driving current $I_{LED3'}$ may be maintained as the third driving current reference value Adim_$I_{ref3}$ corresponding to the dimming level of 80% and dimming-controlled.

At the point in time t6 in which the voltage level of the driving voltage $V_P$ drops over time to become less than the third forward voltage level Vf3, the third LED group driving unit 226 is turned off and the second LED group driving unit 224 is turned on, depending on a control of the LED driving control unit 210, such that the second current path $P_2$ is connected. Therefore, a second LED driving current $I_{LED2'}$ flows through the second current path $P_2$ and the first and second LED groups 310 and 320 emit the light. In this case, as described above, the second LED group driving unit 224 performs a constant current control function, so that the second LED driving current $I_{LED2'}$ may be maintained as the second driving current reference value Adim_$I_{ref2}$ corresponding to the dimming level of 80% and dimming-controlled.

At the point in time t7 in which the voltage level of the driving voltage $V_P$ drops over time to become less than the second forward voltage level Vf2, the second LED group driving unit 224 is turned off and the first LED group driving unit 222 is turned on, depending on a control of the LED driving control unit 210, such that the first current path $P_1$ is connected. Therefore, only the first LED group 310 emits the light, and the first LED group driving unit 222 performs a constant current control function, so that the first LED driving current $I_{LED1'}$ may be maintained as the first driving current reference value Adim_$I_{ref1}$ corresponding to the dimming is level of 80% and dimming-controlled.

In FIG. 5C, waveforms of a driving voltage $V_P$ and an LED driving current $I_{LED''}$ in the case in which a dimming level is set to be relatively low (for example, 40%) are shown. The following Table 3 is a table showing a relationship among a driving section, operation states of LED groups, and a LED driving current in this case.

TABLE 3

| Driving Section | LED Group 1 | LED Group 2 | LED Group 3 | LED Group 4 | $I_{LED''}$ |
|---|---|---|---|---|---|
| t4'~t5 | ON | ON | ON | ON | Adim_$I_{ref4'}$ |
| t5~t6 | ON | ON | ON | OFF | Adim_$I_{ref3'}$ |
| t6~t7 | ON | ON | OFF | OFF | Adim_Iref2' |
| t7~t8 | ON | OFF | OFF | OFF | Adim_Iref1' |

Referring to FIG. 5C, since the dimming level is 40%, a phase control occurred for the driving voltage VP. Therefore, the voltage level of the driving voltage VP is maintained as 0V until a point in time t5'. Therefore, in the case of an exemplary embodiment shown in FIG. 5C, the dimming level detecting unit 140 averages the driving voltage VP to detect a dimming level and outputs the detected dimming level signal Adim to the LED driving module 200. Here, the detected dimming level is 40%, and the dimming level signal Adim input to the LED driving module 200 is substantially a constant voltage signal corresponding to the dimming level of 40%. Therefore, in an exemplary embodiment shown in FIG. 5C, the LED driving module 200 performs a dimming control based on the dimming level of 40%.

Since the voltage level of the driving voltage VP rises to the fourth forward voltage level Vf4 at the point in time t5, the fourth LED group driving unit 228 is turned on, depending on a control of the LED driving control unit 210, such that the fourth current path P4 is connected. Therefore, a fourth LED driving current ILED4" flows through the fourth current path P4 and the first to fourth LED groups 310 to 340 emit the light. In this case, the LED is driving control unit 210 outputs a fourth driving current reference value Adim_Iref4' corresponding to the dimming level of 40% and dimming-controlled to the fourth LED group driving unit 228, and the fourth LED group driving unit 228 detects the fourth LED driving current ILED4" and performs a constant current control function, so that the fourth LED driving current ILED4" may be maintained as the fourth driving current reference value Adim_Iref4' dimming-controlled.

At the point in time t5 in which the voltage level of the driving voltage VP arrives at the maximum value and then falls over time to become less than the fourth forward voltage level Vf4, the fourth LED group driving unit 228 is turned off and the third LED group driving unit 226 is turned on, depending on a control of the LED driving control unit 210, such that the third current path P3 is connected. Therefore, a third LED driving current ILED3" flows through the third current path P3 and the first to third LED groups 310 to 330 emit the light. In this case, as described above, the third LED group driving unit 226 detects the third LED driving current ILED3" and performs a constant current control function so that the third LED driving current ILED3" may be maintained as a third driving current reference value Adim Iref3' input from the LED driving control unit 210, corresponding to the dimming level of 40%, and dimming-controlled.

At the point in time t6 in which the voltage level of the driving voltage VP drops over time to become less than the third forward voltage level Vf3, the third LED group driving unit 226 is turned off and the second LED group driving unit 224 is turned on, depending on a control of the LED driving control unit 210, such that the second current path P2 is connected. Therefore, a second LED driving current ILED2" flows through the second current path P2 and the first and second LED groups 310 and 320 emit the light. In this case, as described above, the is second LED group driving unit 224 performs a constant current control function so that the second LED driving current ILED2" may be maintained as a second driving current reference value Adim_Iref2' corresponding to the dimming level of 40% and dimming-controlled.

At the point in time t7 in which the voltage level of the driving voltage VP drops over time to become less than the second forward voltage level Vf2, the second LED group driving unit 224 is turned off and the first LED group driving unit 222 is turned on, depending on a control of the LED driving control unit 210, such that the first current path P1 is connected. Therefore, only the first LED group 310 emits the light, and the first LED group driving unit 222 performs a constant current control function, so that the first LED driving current ILED1" may be maintained as a first driving current reference value Adim_Iref1' corresponding to the dimming level of 40% and dimming-controlled.

Figure 6A:
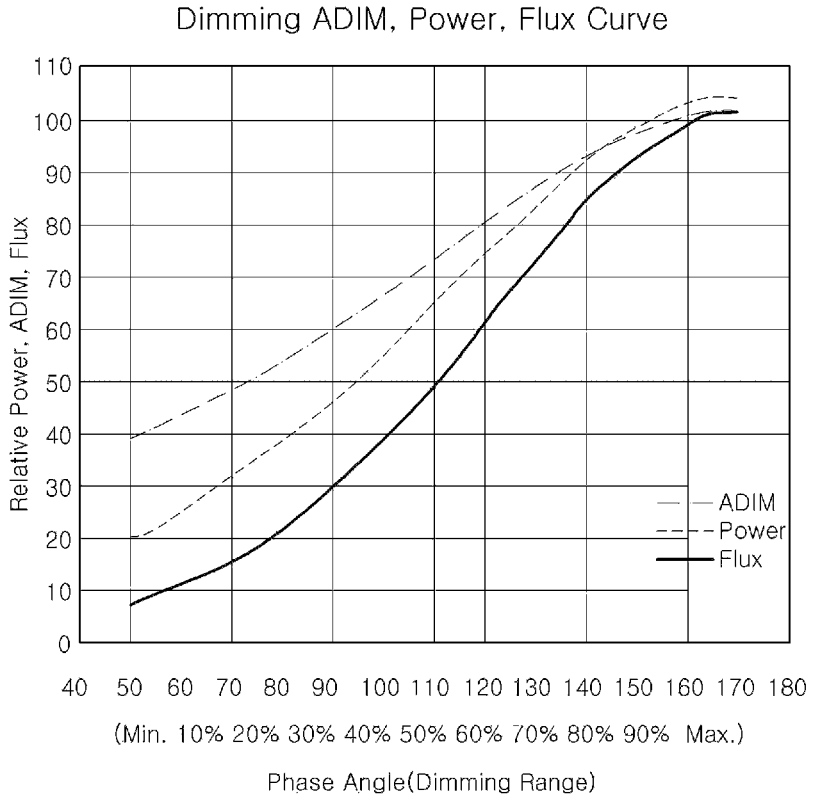
FIG. 6A is a graph showing a relationship among a dimming voltage, a light output, and a flux depending on a dimming level of the dimmable AC driven LED illuminating apparatus according to an exemplary embodiment of the present invention.
Figure 6B:
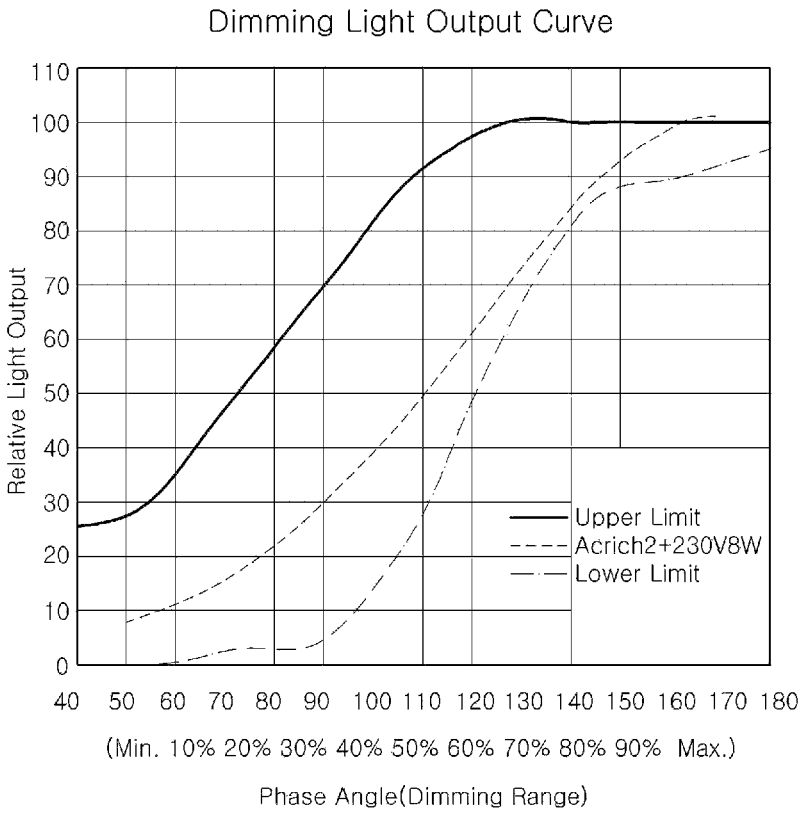
FIG. 6B is a graph showing and a relationship between an upper limit and a lower limit of a light output depending on a dimming level of the dimmable AC driven LED illuminating apparatus according to an exemplary embodiment of the present invention and a light output that may be implemented according to an exemplary implementation.

FIG. 6A is a graph showing a relationship among a dimming voltage, a light output, and a flux depending on a dimming level of the dimmable AC driven LED illuminating apparatus according to an exemplary embodiment of the present invention, and FIG. 6B is a graph showing and a relationship between an upper limit and a lower limit of a light output depending on a dimming level of the dimmable AC driven LED illuminating apparatus according to an exemplary embodiment of the present invention and a light output that may be implemented according to an exemplary implementation. As shown in FIGS. 6A and 6B, it may be confirmed that in the case of using the LED illuminating apparatus 1000, dimming characteristics such as a light output and a flux of the LED illuminating apparatus 1000 are smooth over an entire section of a dimming level and irregular fluctuation does not occur.

As set forth above, according to exemplary embodiments of the present invention, an AC driven LED illuminating apparatus capable of displaying smooth dimming characteristics is over an entire section of a dimming level may be provided.

In addition, according to the present invention, an AC driven LED illuminating apparatus capable of displaying excellent dimming characteristics by interworking with a TRIAC dimmer configured to perform a dimming control using a phase control may be provided.

Further, according to the present invention, an AC driven LED illuminating apparatus capable of overcoming a fluctuation phenomenon when LED groups are sequentially driven may be provided.

Moreover, according to the present invention, an AC driven LED illuminating apparatus capable of more efficiently performing a dimming control using both of a driving voltage phase-controlled depending on a dimming level and an LED driving current of which a magnitude is adjusted may be provided.

Furthermore, according to the present invention, an AC driven LED illuminating apparatus capable of removing an irregular fluctuation phenomenon by maintaining an LED driving current for 1-stage driving as a predetermined value or more even at a minimum dimming level may be provided.

What is claimed is:

1. A dimmable alternating current (AC) driven light emitting diode (LED) illuminating apparatus comprising:

a rectifying unit configured to full-wave rectify controlled AC power to generate a driving voltage;

a dimming level detecting unit configured to detect a selected dimming level and output a detected dimming level signal;

LED groups that each comprise at least one LED; and an LED driving module configured to detect a voltage level of the driving voltage and sequentially drive the LED groups according to the detected voltage level, by constantly controling an LED driving current applied to a driven LED group, based on the dimming level signal, wherein the LED driving module comprises an automatic sensing circuit configured to determine whether a dimming circuit is connected, to automatically select whether a dimming control function is enabled or disabled, wherein the LED driving module determines a reference value of the LED driving current in proportion to a magnitude of the dimming level signal and controls a maximum value of the LED driving current based on the determined reference value.

2. The dimmable AC driven LED illuminating apparatus of claim 1, further comprising a dimmer configured to generate controlled AC power according to the selected dimming level.

3. The dimmable AC driven LED illuminating apparatus of claim 1, wherein the LED driving module is configured to sequentially drive the LED groups by controling a magnitude of the LED driving current, such that the LED driving current has a different magnitude when applied to drive each of the LED groups.

4. The dimmable AC driven LED illuminating apparatus of claim 3, wherein the LED driving module increases the magnitude of the LED driving current applied to each LED group, until all of the at least one LED have been sequentially driven.

5. The dimmable AC driven LED illuminating apparatus of claim 2, wherein the dimmer comprises a TRIAC dimmer configured to generate and output a phase-controlled AC voltage.

6. The dimmable AC driven LED illuminating apparatus of claim 5, further comprising a trigger current maintaining circuit connected between the TRIAC dimmer and the rectifying unit, the trigger current maintaining circuit configured to allow a TRIAC trigger current to flow to an AC power input or a rectified voltage output, or to act as a dummy load.

7. The dimmable AC driven LED illuminating apparatus of claim 6, wherein the trigger current maintaining circuit comprises a bleeder circuit.

8. The dimmable AC driven LED illuminating apparatus of claim 5, further comprising an electromagnetic interference (EMI) filter connected between the dimmer and the rectifying unit, the EMI filter configured to attenuate high frequency noise of the phase-controlled AC voltage.

9. The dimmable AC driven LED illuminating apparatus of claim 1, further comprising a surge protecting unit connected to an output terminal of the rectifying unit.

10. The dimmable AC driven LED illuminating apparatus of claim 1, wherein the dimming level detecting unit is configured to average the driving voltage to detect the selected dimming level.

11. The dimmable AC driven LED illuminating apparatus of claim 10, wherein the dimming level detecting unit comprises an RC integration circuit.

12. The dimmable AC driven LED illuminating apparatus of claim 10, wherein the dimming level detecting unit further comprises a voltage limiting circuit configured to limit the driving voltage to a maximum voltage.

13. The dimmable AC driven LED illuminating apparatus of claim 1, wherein the dimming level detecting unit includes an rms converter embedded in the LED driving module, the dimming level detecting unit is configured to convert the driving voltage into a direct current (DC) signal.

14. The dimmable AC driven LED illuminating apparatus of claim 1, wherein the LED driving module selectively enables the dimming control function.

15. The dimmable AC driven LED illuminating apparatus of claim 14, wherein the automatic sensing circuit is configured to:

connect the LED driving module to a maximum LED driving current setting unit if the dimming control function is disabled; and connect the LED driving module to a dimming-controlled LED driving current setting unit if the dimming control function is enabled, wherein the maximum LED driving current setting unit provides a maximum LED driving current reference value, and wherein the dimming-controlled LED driving current setting unit provides a dimming-controlled LED driving current reference value.

16. The dimmable AC driven LED illuminating apparatus of claim 1, further comprising a driving voltage stabilizing unit configured to decrease and stabilize the driving voltage and supply the stabilized driving voltage to the LED driving module.

* * * * *